United States Patent [19]

Goldberg

[11] 4,120,216

[45] Oct. 17, 1978

[54] CAN OPENER FOR USE WITH RING-TYPE OPENER TABS

[76] Inventor: Norton Robert Goldberg, 8029 Keeler, Skokie, Ill. 60076

[21] Appl. No.: 827,249

[22] Filed: Aug. 24, 1977

[51] Int. Cl.[2] ..... B67G 7/40

[52] U.S. Cl. ..... 81/3.46 A; 220/284; 294/26

[58] Field of Search ..... 220/284, 277; 81/3.46 R, 3.46 A, 3.34, 3.36; 294/26, 1 R

[56] References Cited

U.S. PATENT DOCUMENTS 3,724,297 4/1973 Bucko ..... 81/3.46 A

*Primary Examiner*—George T. Hall

*Attorney, Agent, or Firm*—Norman Lettvin; Marvin S. Siskind

[57] ABSTRACT

Provided herein is an opener for use with ring-type can opening tabs. The opener includes a ring insertion head spaced from an elongated handle by an extension member. The insertion head comprises a pair of ring gripping ears symmetrically positioned about a common longitudinal centerline on which the extension member and insertion head lie. The extension member is tapered inwardly from the handle-extension interface to the head-extension interface, and the head is tapered inwardly from the head-extension interface to a blunt tip formed at the distal head end. The underside of the head is curved upwardly from a point between the ring gripping ears and the tip to the tip, while the ears are tapered upwardly from their underside. The head, because of the curved and tapered ears and tip, is easily slid beneath the tab ring and the ears maneuvered to grip that ring. Upward and forward pressure on the handle is multiplied over the length of the extension member to produce a lever-like mechanical advantage effortlessly opening the can.

5 Claims, 6 Drawing Figures

CAN OPENER FOR USE WITH RING-TYPE OPENER TABS

FIELD OF THE INVENTION

This invention relates to a pop-top can opener, and more particularly, to a can opener for use with ring-type opening tabs.

BACKGROUND OF THE INVENTION

Ring-type opening tabs are found on many varieties of canned goods. Initially limited to the soft-drink industry, their use has spread to many other species of canned foods consumed where special opening utensils might be unavailable.

However, such ring-type opening tabs pose opening problems for certain individual consumers. Thus, men with stubby fingers, women with long nails, or male and female nail biters, have a problem in inserting their fingers beneath the ring, a prerequisite to its removal. Also, since minimum amount of properly directed force must be exerted, some portion of the public, such as young children and the elderly, may possess insufficient manual dexterity or strength to remove the tabs.

It is therefore an object of this invention to provide a can opener for ring-type opener tabs which produce sufficient mechanical advantage to reduce the opening force required.

It is a further object of this invention to provie a can opener for ring-type opener tabs which allows all users, whether man, woman, or child, and regardless of nail shape and size, to open pop-top cans.

These and other objects and advantages of this invention will become clear from the following description of a preferred embodiment of the invention.

BRIEF SUMMARY OF THE INVENTION

The can opener of the present invention provides a novel mechanical expedient for the removal of pull-type can opener tabs. The opener includes a handle from which an insertion head extends outwardly. The head being curved and tapered to its distal, blunt-tipped end, can easily be slipped between the ring of the can opening tab and the can and into the ring. A pair of upwardly and rearwardly extending ears, formed on the opposite end of the head, grip the ring once the head is inserted therein. An upward and forward force on the handle causes the underside of the head to pivot about a point on the scored ring tab. Further force shifts the fulcrum point further toward the blunt tip end of the insertion head, thereby producing a lever-like mechanical advantage provided by the length of extension and head. The result of the application of this lever-like force is quick and effortless ring-type tab removal.

DESCRIPTION OF THE PREFERRED EMBODIMENT

Figure 1:
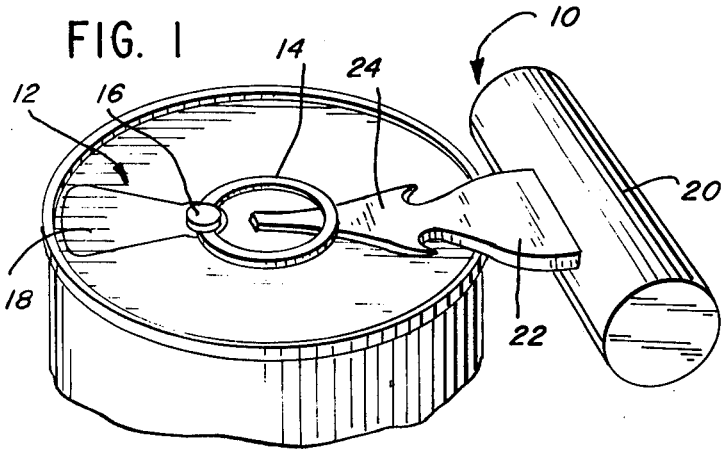
FIGS. 1–3 show perspective views, in various stages of the ring-tab removal, on the top portion of a canned product utilizing a ring-type can opening tab in combination with the can opener of this invention.

Referring now to the drawings, the can opener of this invention is shown generally as 10 and cooperates with the ring-type can opener tabs 12 found on many canned containers. Such tabs 12 usually include a ring 14 connected by a rivet 16 to a removable tab 18. The tab 18 is defined by a scored line which facilitates its removal from the top surface without deforming the remainder of the surface. The ring 14 rests in a plane parallel to the plane of the tab and raised slightly thereabove.

Figure 4:
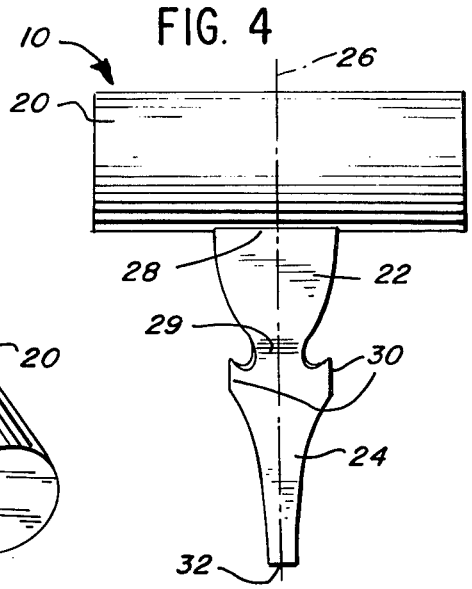
FIG. 4 is a top plan view of the can opener for ring-type can opener tabs of FIGS. 1–3.

The can opener 10 includes an elongated handle 20, an extension member 22 extending outwardly from the handle 20 and an insertion head member 24 formed as a continuance of the extension member 22. Both the extension member and the insertion head member are symmetrically positioned along a longitudinal centerline 26 running from the handle through the length of both members (best seen in FIG. 4). An extension-handle interface 28 is formed at the surface where the extension member 22 intersects the handle 20 and an extension-head interface 24 is formed at the surface where the extension member 22 intersects the head member 24. The extension member 22 tapers from a maximum width at the extension-handle interface to a minimum at the extension-head interface.

Figure 5:
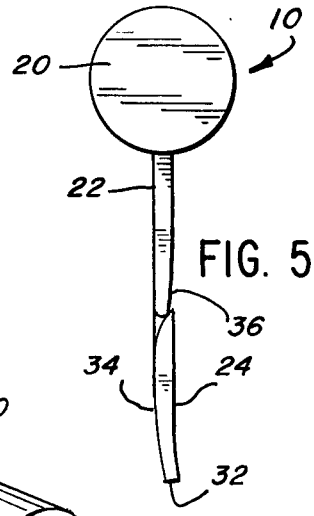
FIG. 5 is a side view of the can opener for ring-type can opener tabs of FIGS. 1–3.

The head member 24 is sized and shaped for insertion into the ring 14 of a ring-type tab 12. The head includes a pair of upwardly and rearwardly directed ears 30 adjacent the extension-head interface 29 and a blunt tip 32 at its distal end. The head member tapers from a maximum width at the extension-head interface 29 to a minimum at the tip 32. As best viewed in FIG. 5, a point 34 exists between the extension-head interface 29 and the tip 32 on the underside of the head member 24 from which the tip portion of the head curves upwardly.

The upwardly and rearwardly directed ears 30 are further flared upward from the underside of the insertion head member 24 while the area about the top surface of the extension-head interface (FIG. 5) is reduced in thickness. This provides a cradle-like surface 36 in which the ring 14 of a ring-type tab 12 may be held.

The handle 20 is shown in FIGS. 1–5 as being cylindrical in shape.

Figure 6:
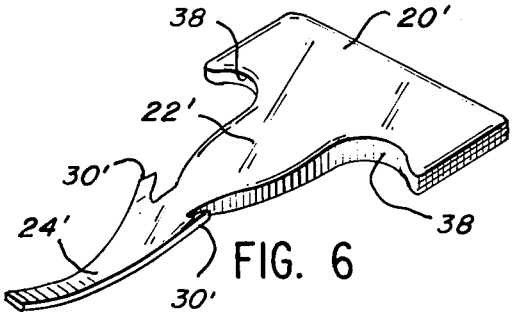
FIG. 6 is a perspective of an alternative preferred embodiment of a can opener for ring-type can opener tabs.

FIG. 6 shows an embodiment wherein the handle 20' is a flat, generally rectangular member. It can be molded from a plastic material with finger gripping indentations 38 formed therein. The extension member 22' and the head member 24' are substantially identical to the members previously described. It should be recognized that still further handle configurations could also be used without departing from the spirit of the invention. The opener is preferably integrally molded from a synthetic resin, but could also be fabricated from wood or metal.

OPERATION

Figure 2:
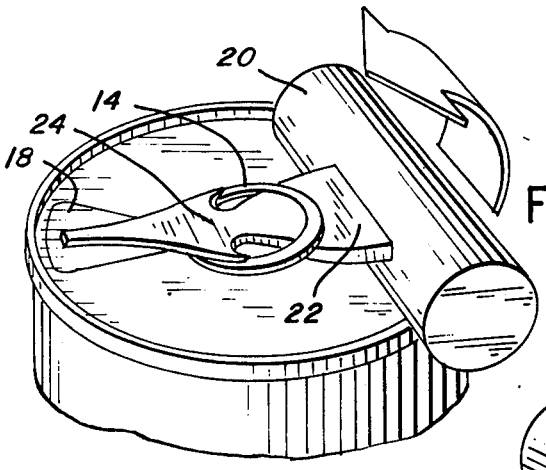
Figure 3:
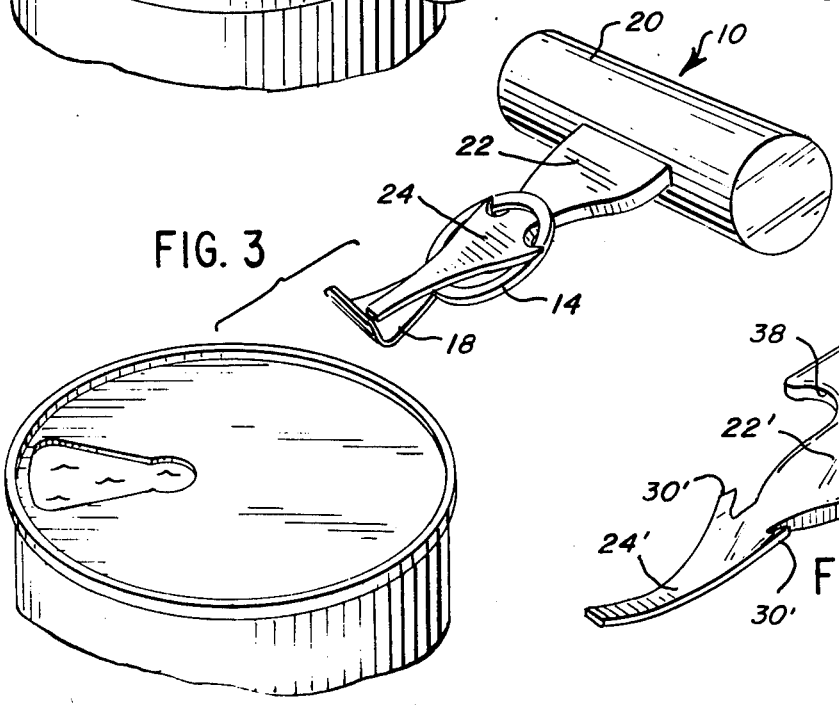

FIGS. 1–3 show the operation of the can opener of the present invention as employed to open a tab-type can.

In FIG. 1, the opener 10 is depicted with its tapered, blunt tip 32 inserted between the ring 14 and the can surface. By continuing to push the opener forwardly, the insertion head member 24 is moved through the ring 14 to assume the position of FIG. 2. As the handle 20 is rotated forwardly and upwardly (as shown by the arrow in FIG. 2), the upwardly and rearwardly directed ears 30 grip the ring 14. The point 34, on the underside of the head member 24, rests on a portion of the ring tab 18 and serves as an initial, force-transmitting fulcrum. Further movement of the handle 20 lifts the ring 14 upwardly while shifting the fulcrum point further toward the blunt tip end of the head member 24.

Due to the lever-like action of the opener as it pivots about the fulcrum and uses the mechanical advantage provided by the length of the extension member 22 and the head member 24, continued upward handle movement easily releases the scored ring-type opener tab from the can (FIG. 3).

While one form of the invention has been described, it will be understood that the invention may be utilized in other forms and environments, so that the purpose of the appended claims is to cover all such forms of devices not disclosed but which embody the invention disclosed herein.

What is claimed and desired to be secured by Letters Patent of the United States is:

1. An opener for use with ring-type can opening tabs comprising:

an elongated handle;

head-insertion means sized and shaped for insertion into the ring of a pull-tab can, the head insertion means having force transmitting fulcrum means sized and shaped for insertion into the ring of a pull-tab can along with the head-insertion means;

extension means connecting the head-insertion means to the handle thereby forming extension-handle and extension-head interfaces; and the head-insertion means including: (a) tip means at the end thereof opposite the extension-head interface; and (b) means for gripping the pull-tab can ring adjacent the extension-head interface whereby the head-insertion means may be inserted in one direction in a gripping position within the ring of a pull-tab can and the can may be easily opened by exerting an upward and forward force in the other direction on the handle.

2. An opener for use with ring-type can opening tabs comprising:

an elongated handle;

head-insertion means sized and shaped for insertion into the ring of a pull-tab can;

extension means connecting the head-insertion means to the handle thereby forming extension-handle and extension-head interfaces;

the head-insertion means including: (a) tip means at the end thereof opposite the extension-head interface; and (b) means for gripping the pull-tab can ring adjacent the extension-head interface;

the extension means and the head-insertion means having a common longitudinal centerline;

the extension means tapering inwardly from the extension-handle interface to the extension-head interface;

the head-insertion means (a) tapering inwardly from the extension-head interface to the tip means; and (b) curving upwardly from a point between the ring gripping means and the tip means to the tip means; and the ring gripping means comprising a pair of rearwardly extending ring gripping ears, the ears symmetrically disposed on opposite sides of the centerline, whereby the head-insertion means may be inserted in one direction in a gripping position within the ring of a pull-tab can and the can may be easily opened by exerting an upward and forward force in the other direction on the handle.

3. The opener of claim 2, wherein the ring gripping ears are flared upwardly from the underside of the head-insertion means, the area on the top surface adjacent the extension-head interface being reduced in thickness.

4. The opener of claim 3, wherein the handle is cylindrically shaped and the handle, extension means and head-insertion means are integrally molded.

5. The opener of claim 3, wherein the handle is generally rectangularly shaped and the handle, extension means and head-insertion means are integrally molded.

* * * * *